US008672716B2

(12) United States Patent
De France

(10) Patent No.: US 8,672,716 B2
(45) Date of Patent: Mar. 18, 2014

(54) ADJUSTABLE CLAMPING DEVICE

(75) Inventor: Robert Victor De France, Poughkeepsie, NY (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 13/371,027

(22) Filed: Feb. 10, 2012

(65) Prior Publication Data

US 2012/0214355 A1 Aug. 23, 2012

Related U.S. Application Data

(60) Provisional application No. 61/444,347, filed on Feb. 18, 2011.

(51) Int. Cl.
*H01R 4/30* (2006.01)

(52) U.S. Cl.
USPC ..... 439/803

(58) Field of Classification Search
USPC ..... 439/794, 479, 803, 801, 723; 238/333, 238/336, 349; 174/168; 24/135 R
See application file for complete search history.

(56) References Cited

U.S. PATENT DOCUMENTS

| | | | | | |
|---|---|---|---|---|---|
| 2,738,480 | A | | 3/1956 | Hubbard | |
| 2,858,522 | A | * | 10/1958 | Wengen et al. | 439/727 |
| 2,867,787 | A | * | 1/1959 | Nilsson | 439/803 |
| 3,075,166 | A | * | 1/1963 | Peek | 439/479 |
| 3,425,028 | A | * | 1/1969 | Neaderland | 439/723 |
| 3,553,351 | A | | 1/1971 | Lindsey | |
| 3,923,363 | A | * | 12/1975 | Kraft | 439/413 |
| 4,281,213 | A | * | 7/1981 | Sciscione | 174/68.2 |
| 4,707,891 | A | | 11/1987 | Chidester | |
| 4,846,725 | A | | 7/1989 | Williams | |
| 5,240,441 | A | * | 8/1993 | Laricchia et al. | 439/783 |
| 5,320,565 | A | | 6/1994 | Polidori | |
| 5,423,699 | A | | 6/1995 | Johnson | |
| 6,045,414 | A | * | 4/2000 | DeFrance | 439/794 |
| 6,390,861 | B1 | | 5/2002 | DeFrance | |
| 6,799,757 | B1 | * | 10/2004 | Lang | 269/266 |
| 7,641,128 | B2 | * | 1/2010 | Remington et al. | 238/333 |
| 7,766,702 | B2 | | 8/2010 | De France | |
| 8,313,041 | B2 | * | 11/2012 | Remington et al. | 238/333 |
| 8,393,114 | B2 | * | 3/2013 | Haab et al. | 49/425 |
| 2002/0142674 | A1 | | 10/2002 | Chadbourne et al. | |

* cited by examiner

*Primary Examiner* — Alexander Gilman
(74) *Attorney, Agent, or Firm* — Marcus R. Mickney; Mark S. Bicks; Alfred N. Goodman

(57) ABSTRACT

An adjustable clamping device includes a wedge pad and a conductor pad. The wedge pad has a first fastener hole and a wedge receiving surface. The conductor pad has a second fastener hole and a conductor receiving surface. The conductor receiving surface faces the wedge receiving surface to receive a wedge and a conductor therebetween. A fastener is received by the first and second fastener holes to adjustably connect the wedge pad to the conductor pad. A spring member is disposed on the fastener, abuts the wedge pad and biases the wedge pad toward the conductor pad to facilitate retaining the wedge and conductor between the wedge receiving surface and the conductor receiving surface. The spring member allows spacing between the wedge pad and conductor pad to be adjusted to accommodate various sized wedges and conductors while maintaining pressure on the received wedge and conductor.

19 Claims, 23 Drawing Sheets

ADJUSTABLE CLAMPING DEVICE

CROSS REFERENCE TO RELATED APPLICATION

This application claims the benefit under 35 U.S.C. §119 (e) of U.S. Provisional Patent Application Ser. No. 61/444,347, filed Feb. 18, 2011, which is hereby incorporated by reference in its entirety

FIELD OF THE INVENTION

The present invention relates generally to a clamping device for connecting a conductor to an object. More particularly, the present invention relates to a clamping device for connecting a conductor to an object such that the clamping device is removable. Still more particularly, the present invention relates to a clamping device that is adjustable to accommodate a range of conductor sizes.

BACKGROUND OF THE INVENTION

In the electrical utilities industry, it is sometimes required to disconnect the current from electrical conductors at electrical distribution poles. This disconnection is most often performed at the pole. However it can be accomplished on the line by utilizing a line disconnect device, which may, for example, be an in-line switch.

An in-line switch generally comprises two mechanical dead ends with an insulator therebetween, as disclosed in U.S. Pat. No. 7,766,702 to De France et al. and which is hereby incorporated by reference in its entirety. The mechanical dead ends may also comprise a separate wedge connector, as disclosed in U.S. Pat. No. 5,240,441 to Laricchia et al. and which is hereby incorporated by reference in its entirety, for use in electrical transmission lines. The conductor is mechanically connected to each dead end and than cut in center between the dead ends. The dead ends may have a knife switch blade mounted or fastened to each dead end. The knife switch blade allows the current to flow from one dead end to the other. The knife switch blade may be permanently fastened to one of the dead ends and may be disconnectable from the other. When one end of the blade is disconnected from the other dead end, the flow of current between the dead ends is stopped.

Conventional configurations require a separate wedge of the wedge connector to be attached to the mechanical dead end between a wedge connector shell and the conductor. A utility worker may have several components of the in-line switch to account for when making these connections. As the number of components and complexity increases for these operations, maintenance down times may increase. This can add up to be a very costly operation for the utility company.

Accordingly, there is a need to provide a clamping device that is adjustable to accommodate a range of sizes of conductors and objects to which the conductor is connected.

SUMMARY OF THE INVENTION

An object of the present invention is to provide a clamping device that is adjustable to accommodate a range of conductor sizes.

Another object of the present invention is to provide a clamping device that is adjustable to be connectable to a variety of different objects.

Another object of the present invention is to provide a clamping device that is removable such that the clamping device can be reused.

The foregoing objectives are basically attained by an adjustable clamping device including a wedge pad and a conductor pad. The wedge pad has a first fastener hole and a wedge receiving surface. The conductor pad has a second fastener hole and a conductor receiving surface. The conductor receiving surface faces the wedge receiving surface to receive a wedge and a conductor therebetween. A fastener is received by the first and second fastener holes to adjustably connect the wedge pad to the conductor pad. A spring member is disposed on the fastener, abuts the wedge pad and biases the wedge pad toward the conductor pad to facilitate retaining the wedge and conductor between the wedge receiving surface and the conductor receiving surface. The spring member allows spacing between the wedge pad and conductor pad to be adjusted to accommodate various sized wedges and conductors while maintaining pressure on the received wedge and conductor.

Objects, advantages, and salient features of the invention will become apparent from the following detailed description, which, taken in conjunction with the annexed drawings, discloses an exemplary embodiment of the present invention.

As used in this application, the terms "front," "rear," "upper," "lower," "upwardly," "downwardly," and other orientational descriptors are intended to facilitate the description of the clamping device, and are not intended to limit the structure of the clamping device to any particular position or orientation.

BRIEF DESCRIPTION OF THE DRAWINGS

The above benefits and other advantages of the various embodiments of the present invention will be more apparent from the following detailed description of exemplary embodiments of the present invention and from the accompanying drawing figures, in which.

Throughout the drawings, like reference numerals will be understood to refer to like parts, components and structures.

DETAILED DESCRIPTION OF AN EXEMPLARY EMBODIMENT

Figure 27:
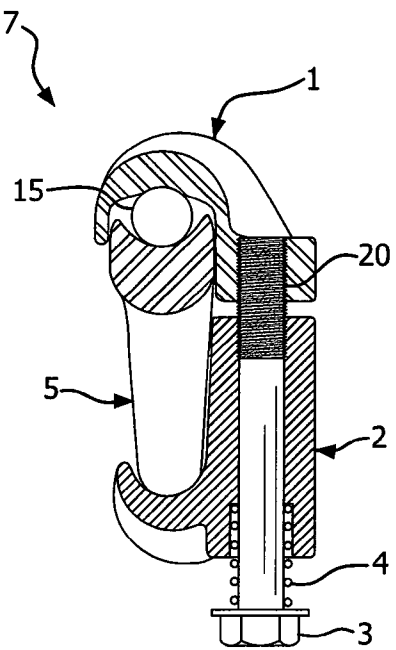
Figure 26:
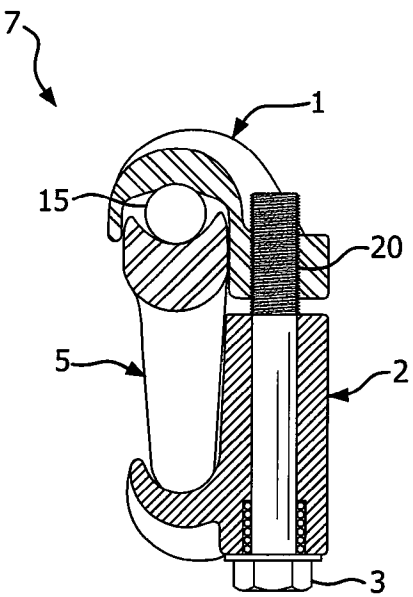
Figure 25:
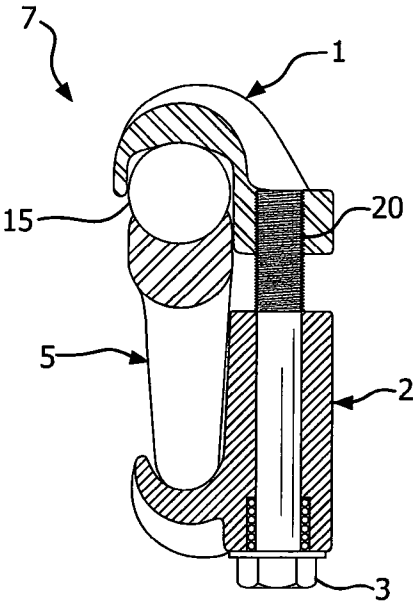
Figure 28:
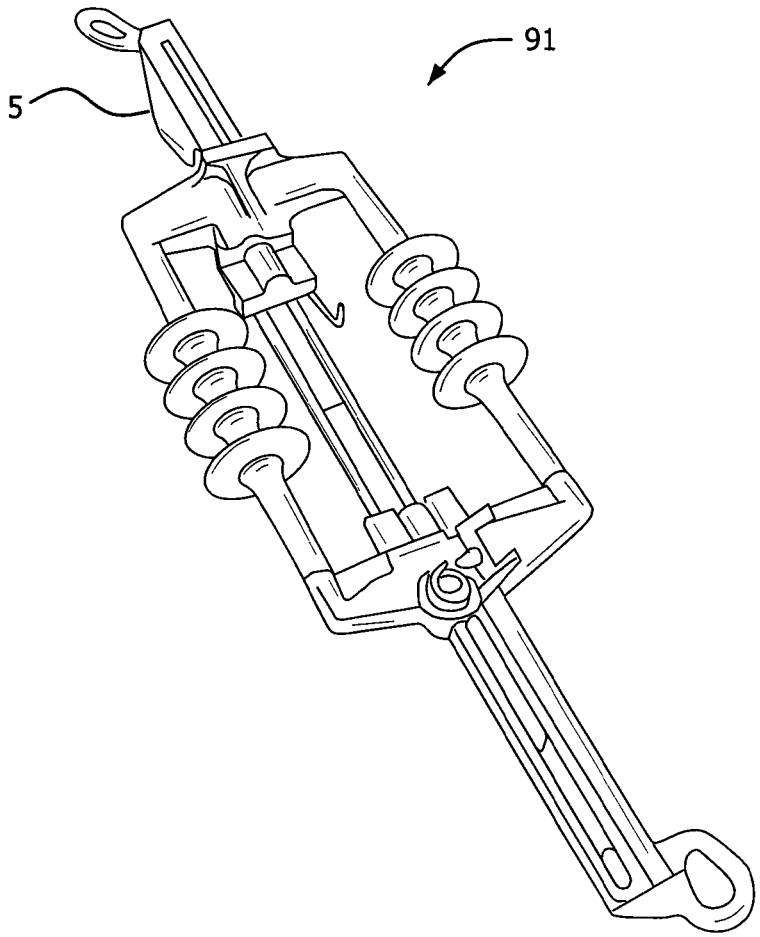
FIGS. 28-30 are perspective, top plan and side elevational views of a conventional in-line disconnect switch.
Figure 29:
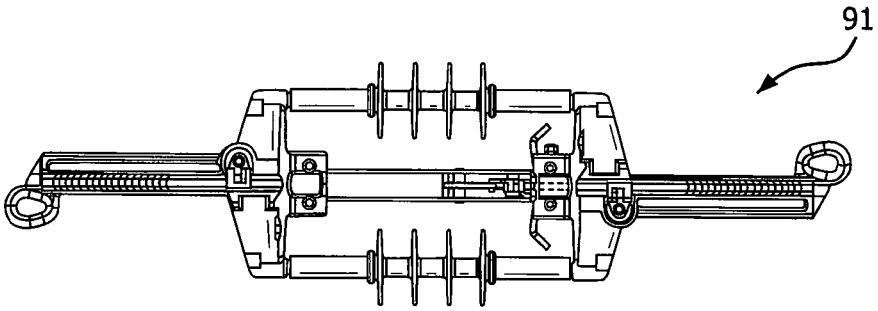

In an exemplary embodiment of the present invention shown in FIGS. 1-33, an adjustable clamping device 7 is adapted to connect a conductor 15 to a wedge body 5 of an in-line switch 91 (FIGS. 27-29). The clamping device 7 includes a conductor pad 1, a wedge pad 2, first and second fasteners 3 and 33 and first and second spring members 4. The clamping device 7 is adjustable to accommodate a range of conductor sizes, as well as to be connectable to a variety of objects, such as an in-line switch 91 or a utility pole.

Figure 16:
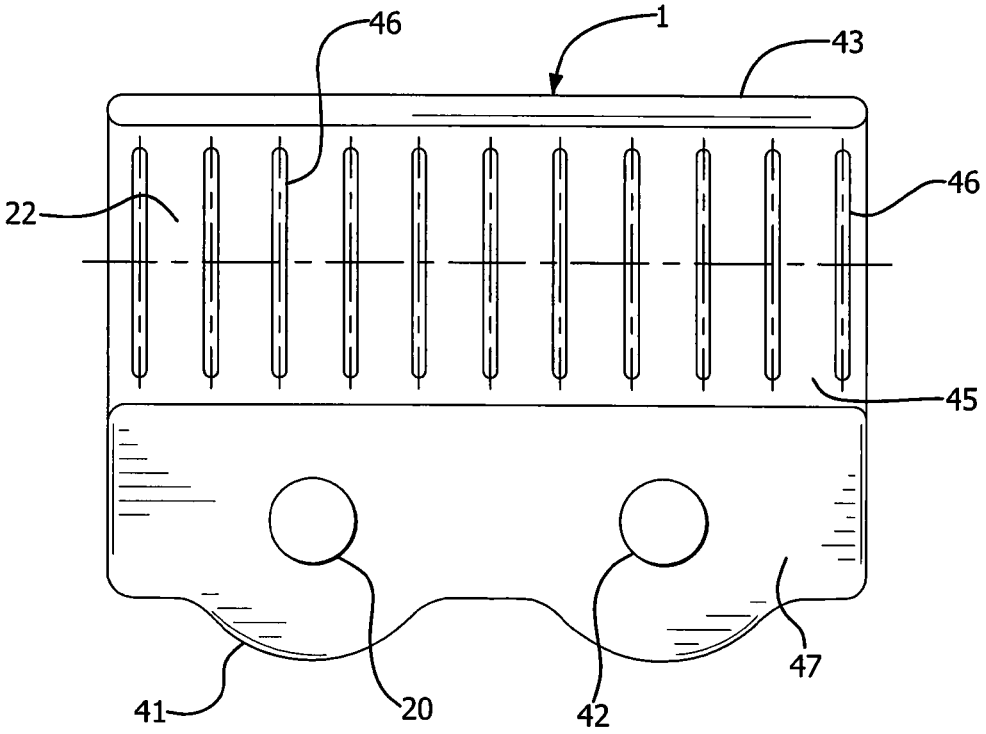
FIG. 16 is a bottom plan view of the conductor pad of the clamping device of FIG. 1.
Figure 17:
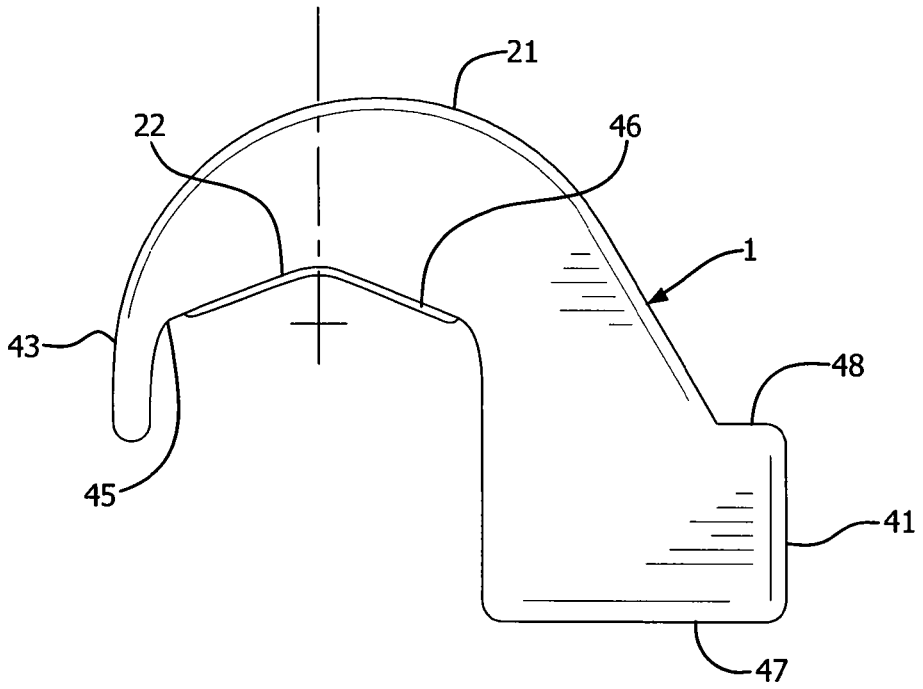
FIG. 17 is a side elevational view of the conductor pad of FIG. 16.
Figure 19:
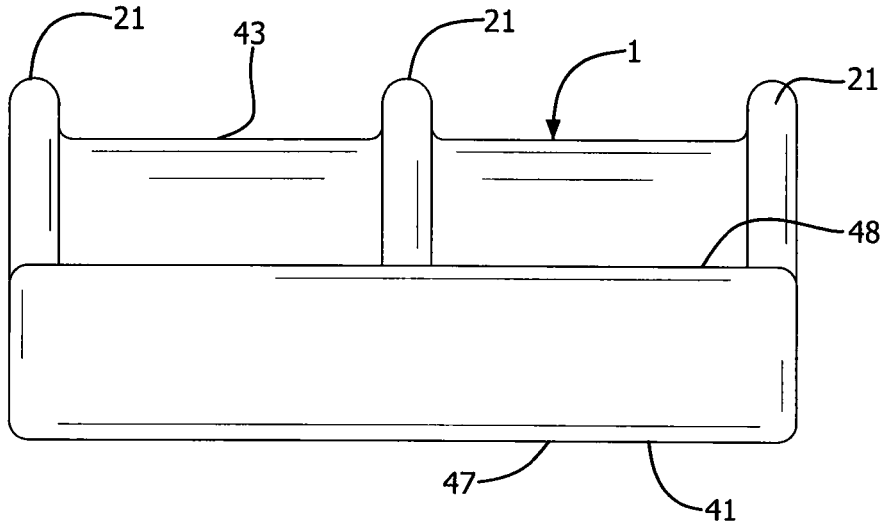
FIG. 19 is a rear elevational view of the conductor pad of FIG. 16.
Figure 18:
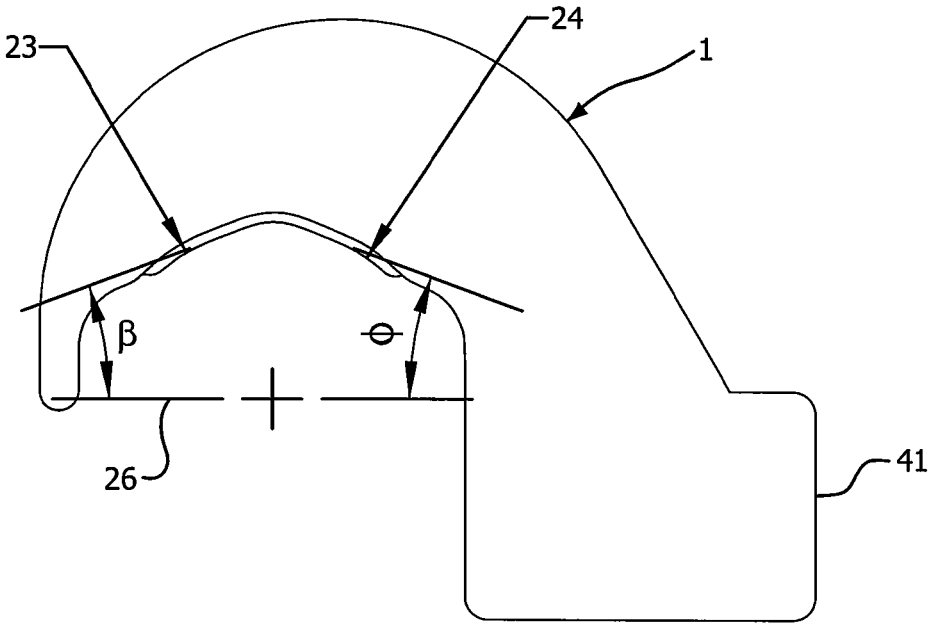
FIG. 18 is a side elevational view of the conductor pad of FIG. 17 indicating angles of conductor groove surfaces thereof.
Figure 20:
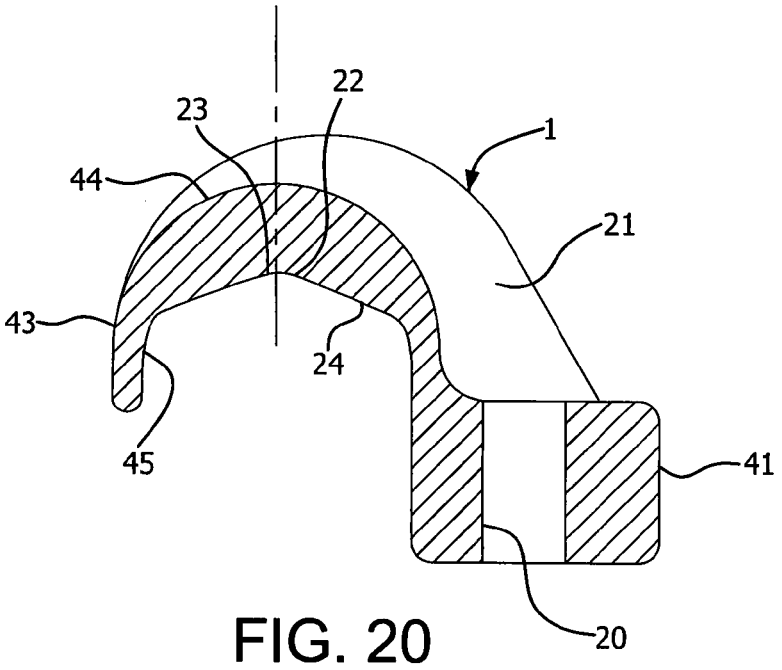
FIG. 20 is a side elevational view in cross section of the conductor pad of FIG. 16.

The conductor pad 1, as shown in FIGS. 1-3 and 16-21, has a main body 41 and a conductor receiving portion 43 connected thereto. Fastener holes 20 and 42 extend from a lower surface 47 of the main body 41 to an upper surface 48 thereof, as shown in FIG. 19. Preferably, the fastener holes 20 and 42 are threaded. The conductor receiving portion 43 has an outer surface 44 and an inner surface 45. The inner surface 45 forms a conductor groove 22 that receives the conductor 15. The conductor groove 22 is a combination of surfaces 23 and 24 and angles β and θ, as shown in FIG. 18, that allow the clamping device 7 to accommodate a wide range of conductor diameters as shown in FIGS. 22-27. The first surface 23 is adapted to accommodate a conductor having a larger diameter, and the second surface 24 is adapted to accommodate a conductor having a smaller diameter. The first surface 23 forms an angle β with the horizontal axis 26 and the second surface 24 forms an angle θ with the horizontal axis 26. Preferably, the angles β and θ are different from each other. By disposing the first and second surfaces 23 and 24 at different angles, the clamping device 7 is able to contact the outer strands of the smallest and largest diameter conductors 15. A first plurality of ribs 46 extend downwardly from the inner surface 45 of the conductor groove 22, as shown in FIGS. 16 and 17, that grip into the conductor 15 such that the clamping device 7 moves with the conductor 15 when tension is applied thereto.

Figure 1:
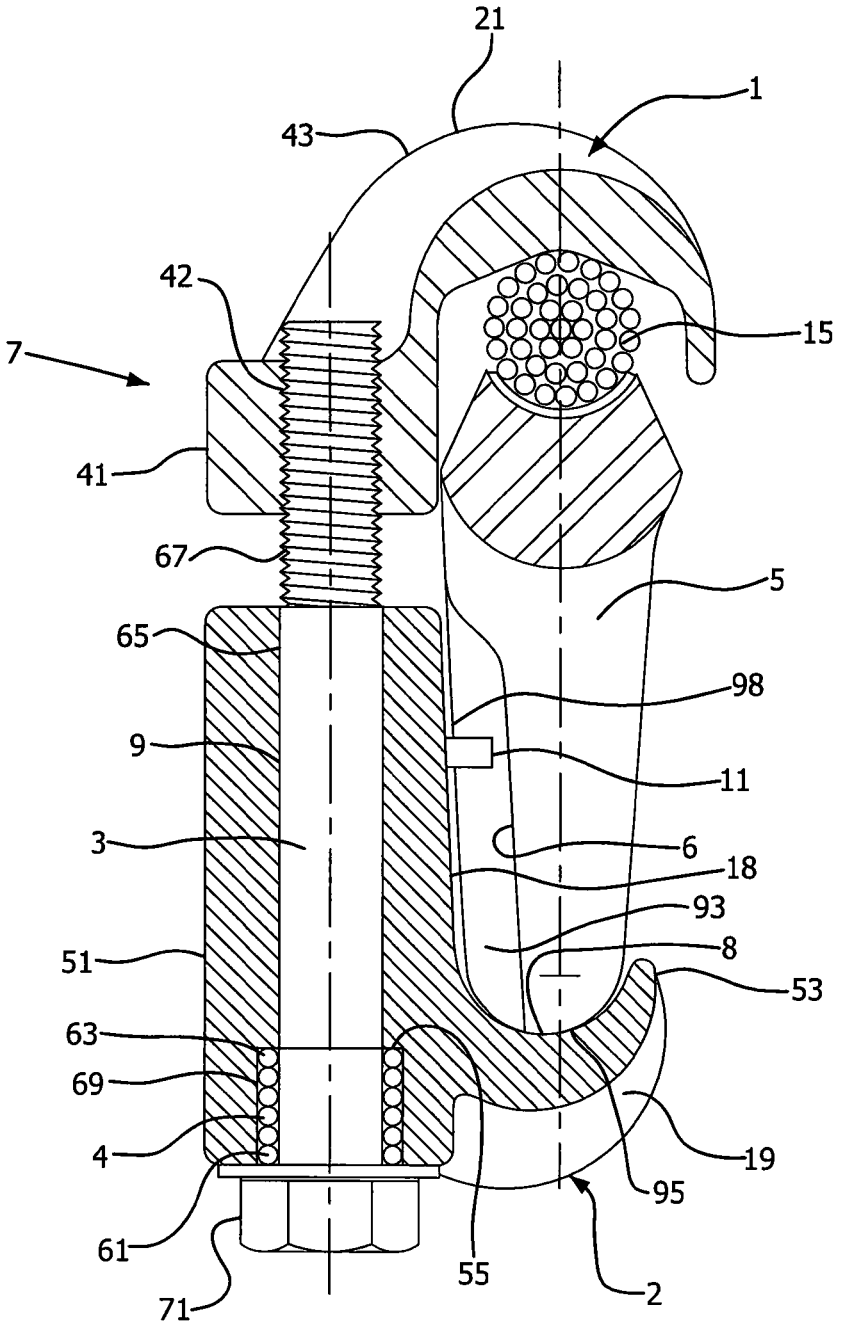
FIG. 1 is a side elevational view in cross section of a clamping device in accordance with an exemplary embodiment of the present invention.
Figure 2:
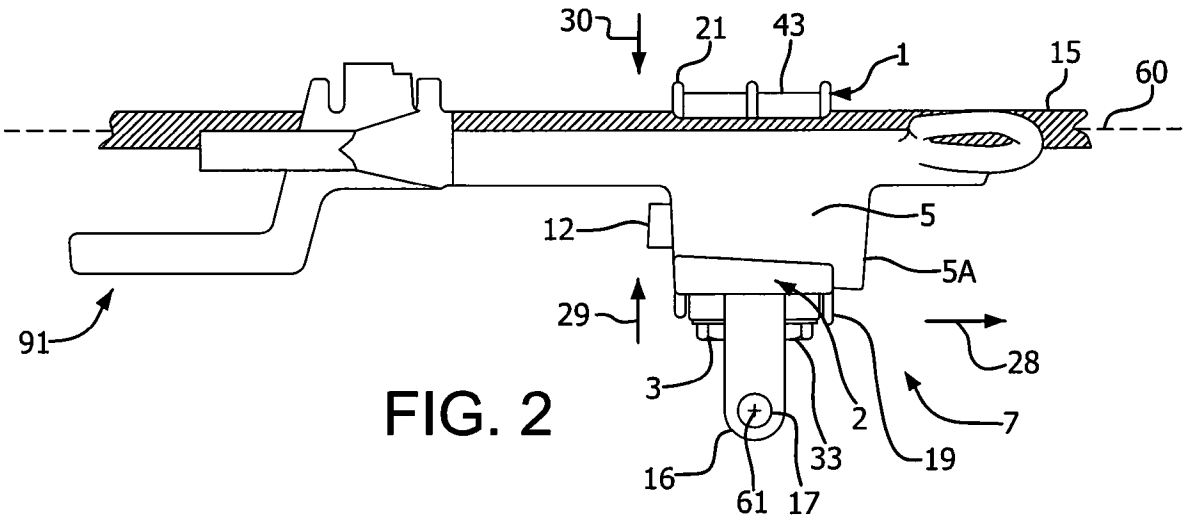
FIG. 2 is a front elevational view of the clamping device of FIG. 1.
Figure 21:
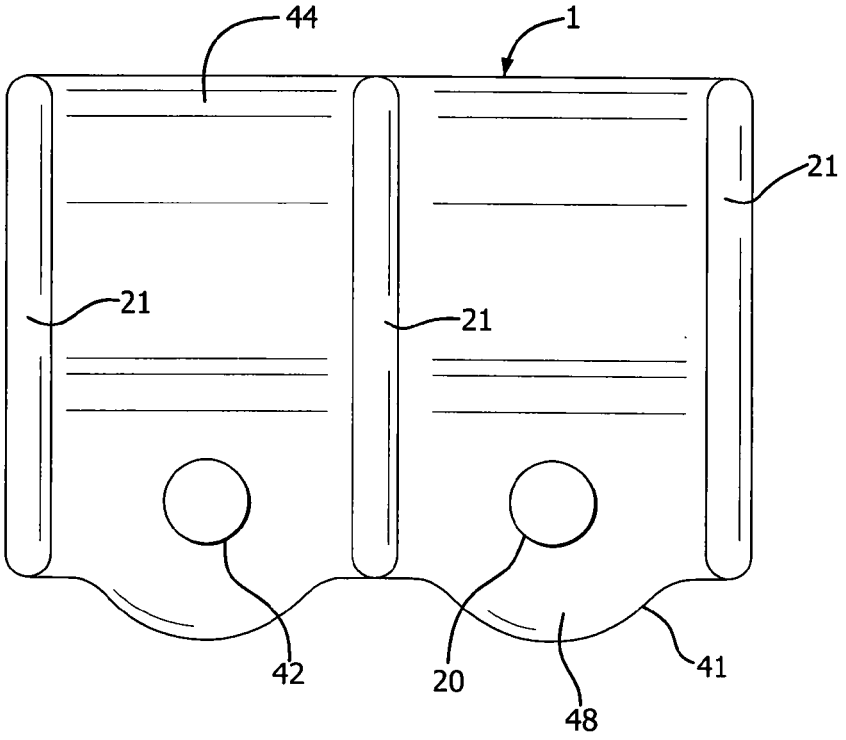
FIG. 21 is a top plan view of the conductor pad of FIG. 16.
Figure 24:
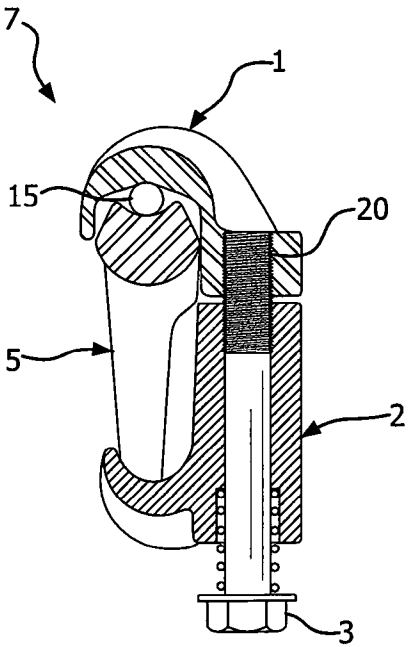
FIGS. 22-27 are side elevational views in cross section of the clamping device receiving different sized wedge bodies and conductors.
Figure 23:
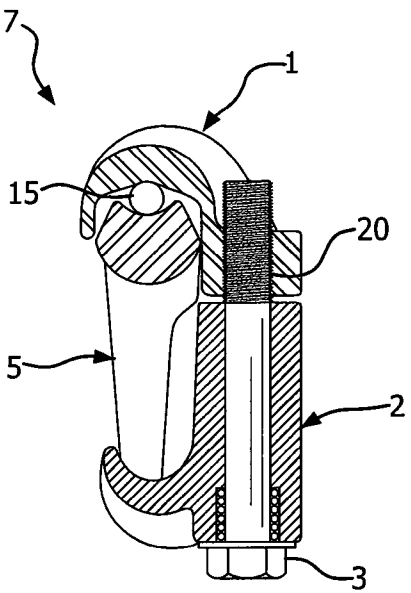
Figure 22:
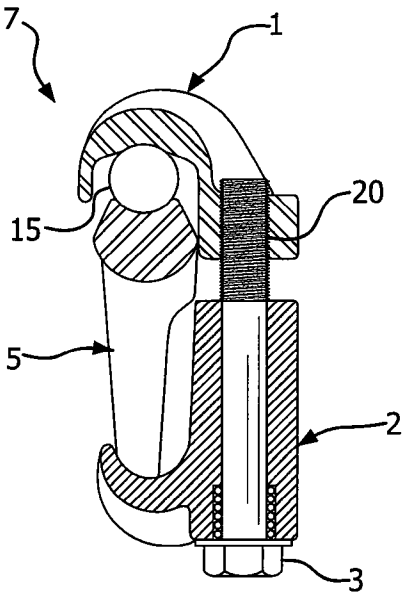

A second plurality of ribs 21 extend upwardly from the main body 41 and along the outer surface 44, as shown in FIG. 21. The ribs 21 extend substantially perpendicular to a longitudinal axis 60 of the received conductor 15, as shown in FIGS. 1, 2 and 17. The ribs 21 structurally reinforce the conductor pad 1, and substantially prevent outward flaring of the conductor receiving portion 43 when force is applied thereto when connecting a conductor 15. Preferably, the conductor pad 1 is integrally formed as a one-piece member.

Figure 11:
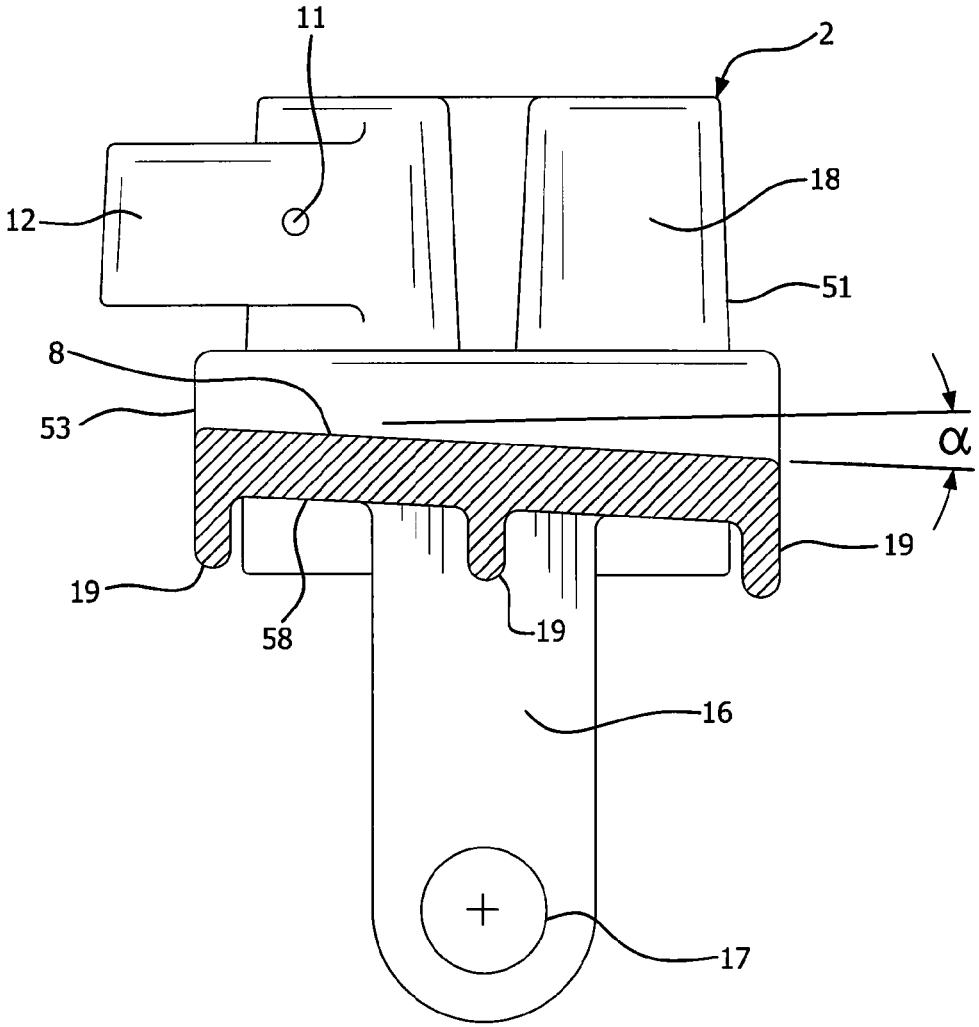
FIG. 11 is a front elevational view in cross section of the wedge pad of FIG. 8.
Figure 12:
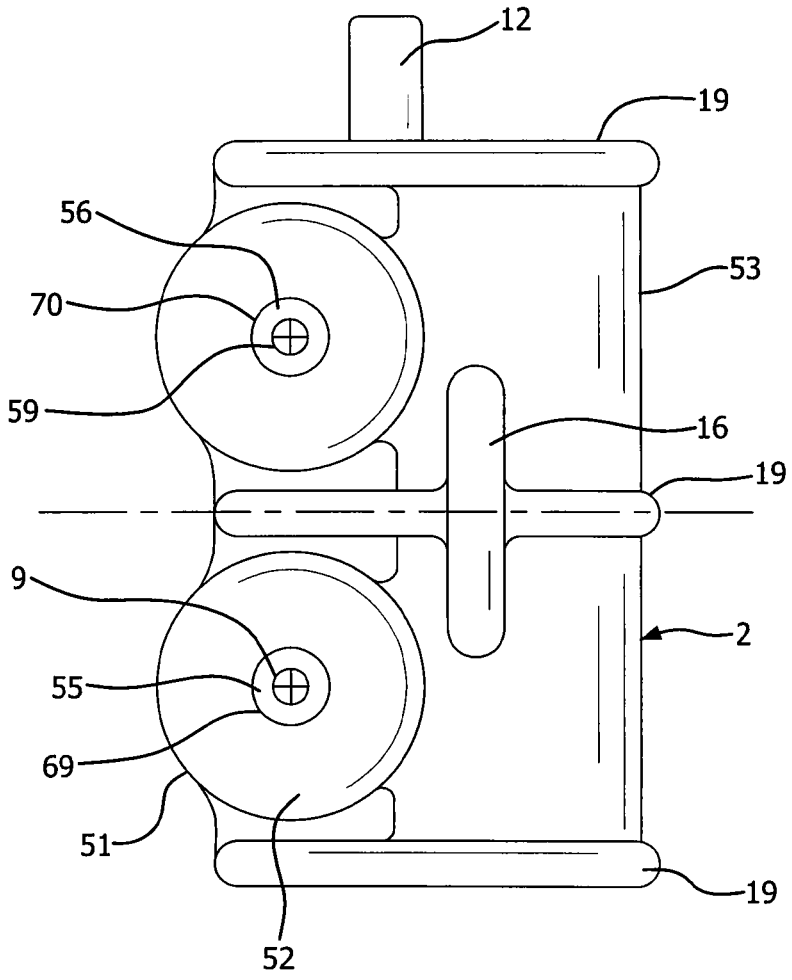
FIG. 12 is a bottom plan view of the wedge pad of FIG. 8.
Figure 13:
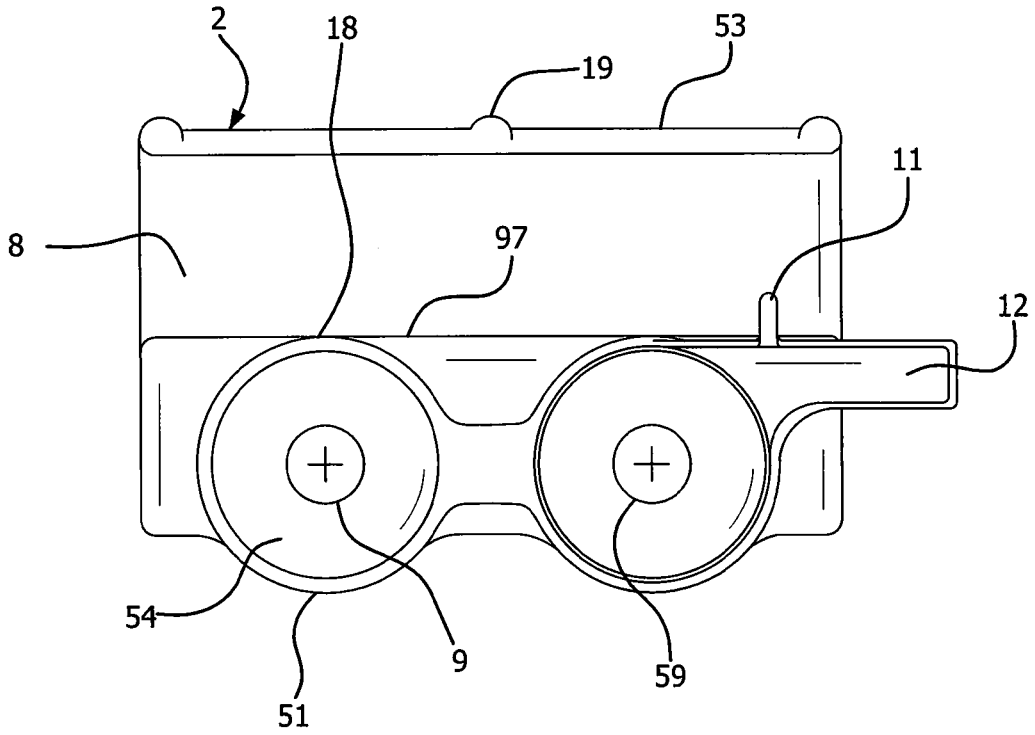
FIG. 13 is a top plan view of the wedge pad of FIG. 8.
Figure 14:
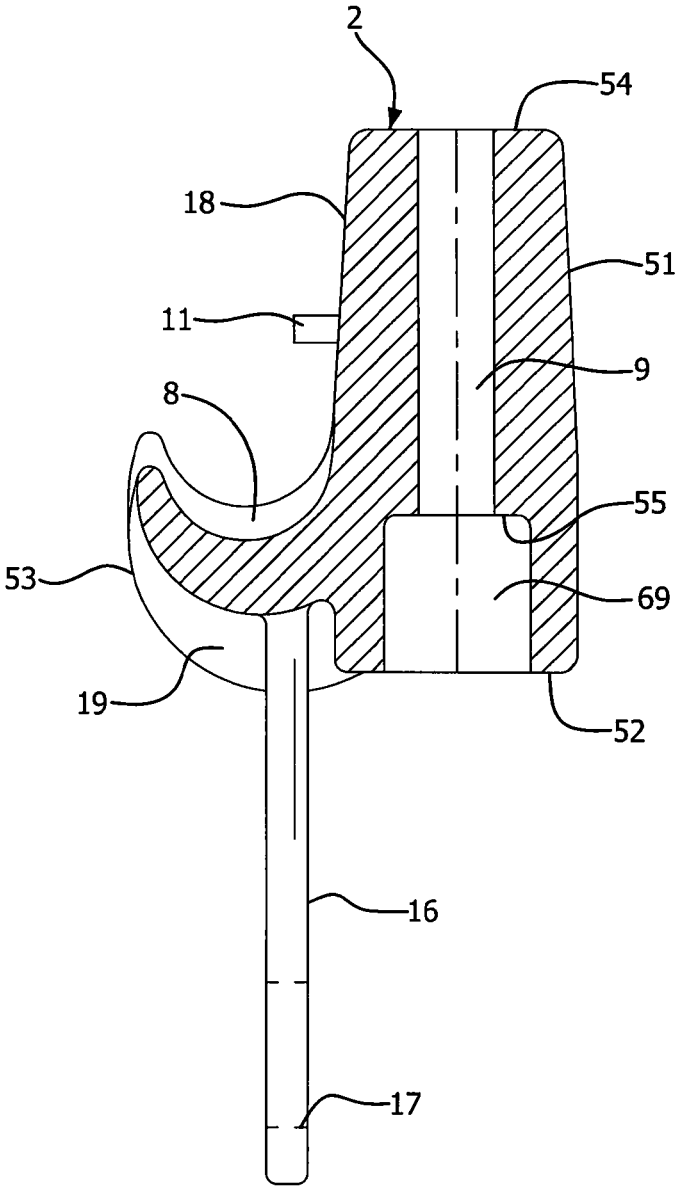
FIG. 14 is a side elevational view in cross section of the wedge pad of FIG. 8 showing a counterbore for receiving a spring member.
Figure 15:
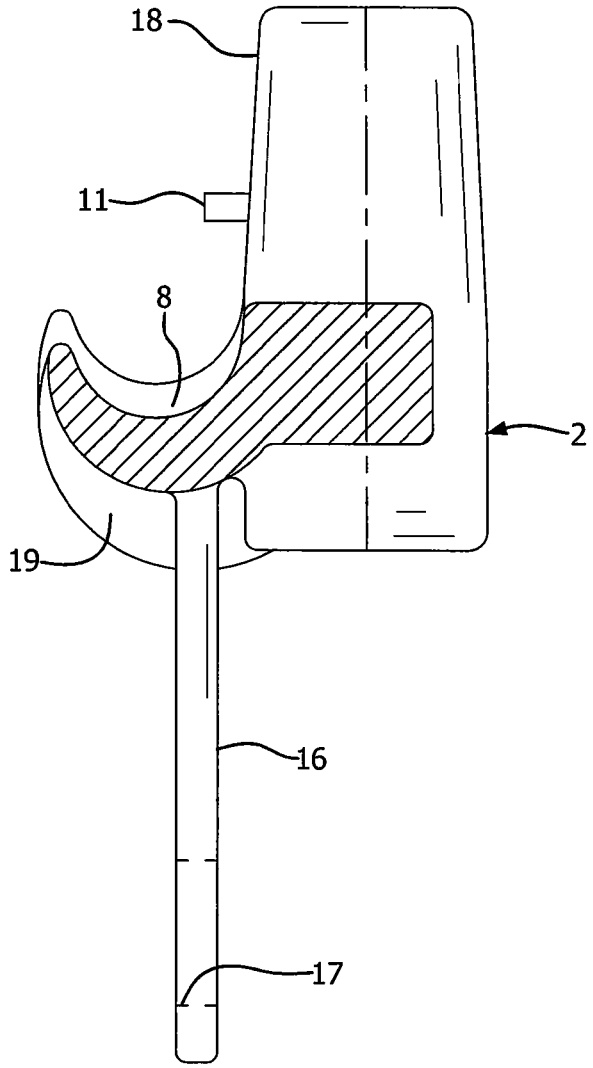
FIG. 15 is a side elevational view in cross section of the wedge pad of FIG. 8.

The wedge pad 2, as shown in FIGS. 1-3 and 8-15, includes a main body 51 and a wedge body receiving portion 53 connected thereto. First and second holes 9 and 59 extend from a lower surface 52 to an upper surface 54 of the main body 51, as shown in FIGS. 12 and 14. Counterbores 69 and 70 are formed in each of the first and second holes 9 and 59 proximal the lower surface 52 such that shoulders 55 and 56 are formed therein, as shown in FIG. 12.

Figure 3:
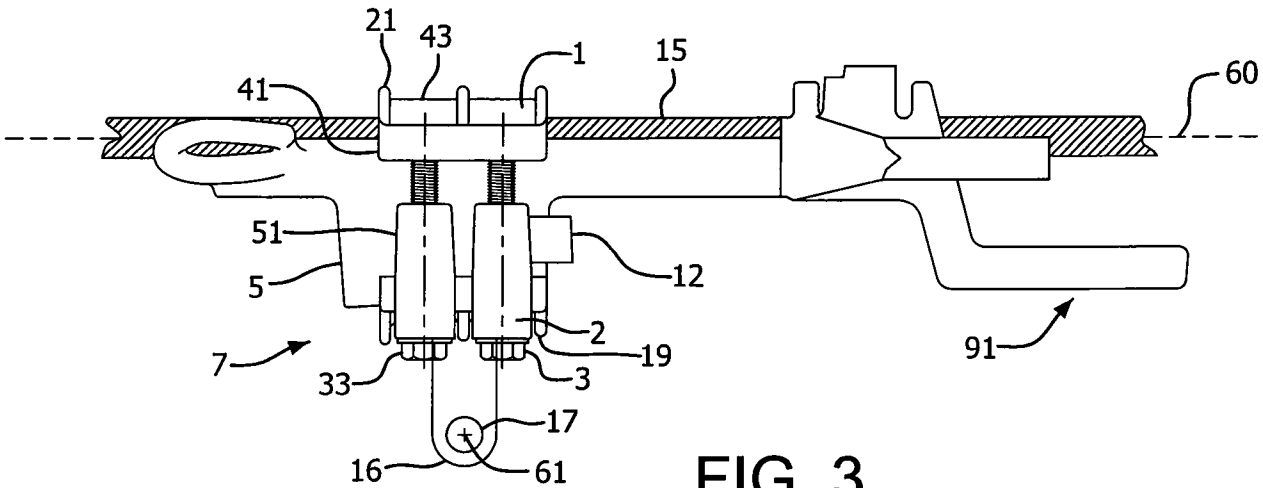
FIG. 3 is a rear elevational view of the clamping device of FIG. 1.

A wedge body receiving surface 8 is formed in the receiving portion 53, as shown in FIGS. 13 and 14. Preferably, the wedge body receiving surface 53 is tapered, as shown in FIGS. 11 and 14, and tapers downwardly away from a second tab 12 of the wedge pad 2. The tapered surface preferably has an angle α that is approximately three (3) degrees or less, as shown in FIG. 11. The wedge body receiving surface 8 has a concave radius groove that preferably extends along an entire length of the receiving portion 53, as shown in FIGS. 11 and 13. A plurality of support ribs 19 extend outwardly from an outer surface 58 of the receiving portion 53 of the wedge pad 2, as shown in FIGS. 11 and 12, to structurally reinforce the receiving portion 53 and to substantially prevent the wedge body receiving surface 8 from flaring outwardly when force is applied thereto. The support ribs 19 preferably extend substantially perpendicular to the longitudinal axis 60 of the received conductor 15, as shown in FIGS. 2 and 3.

Figure 8:
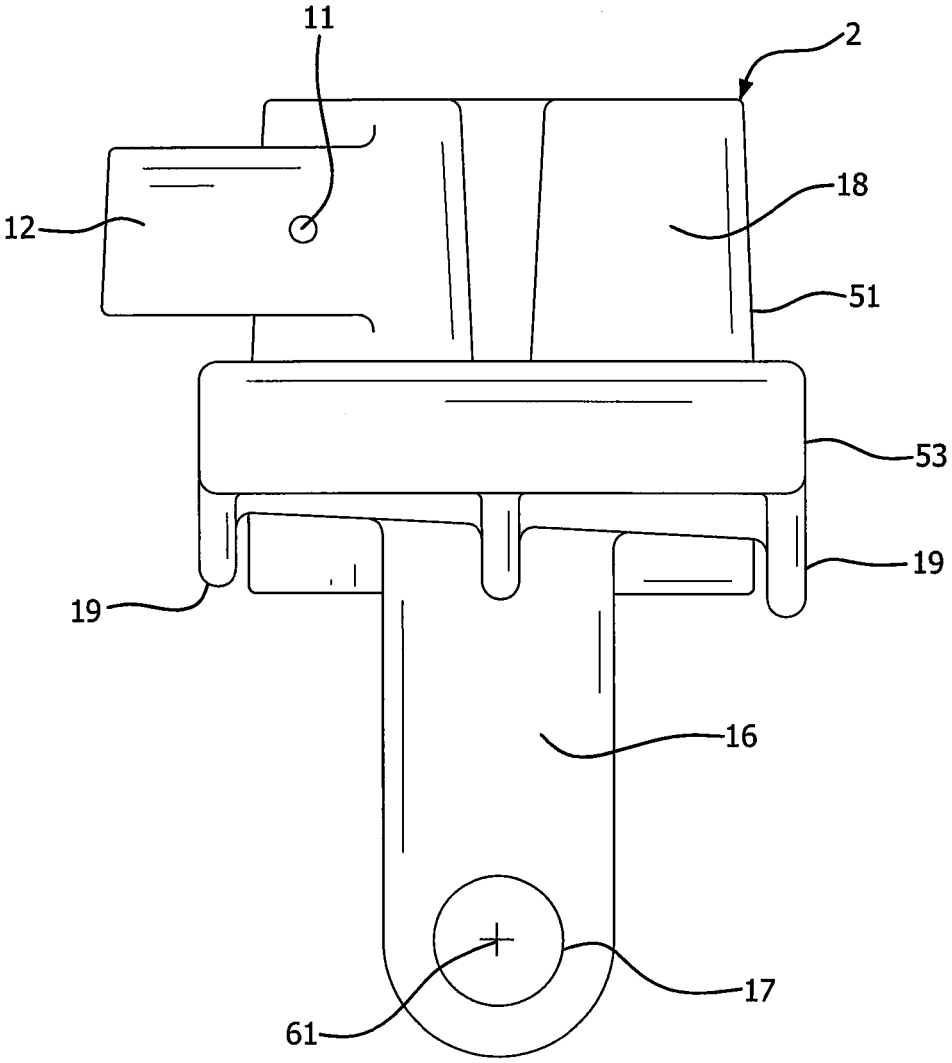
FIG. 8 is a front elevational view of a wedge pad of the clamping device of FIG. 1.
Figure 9:
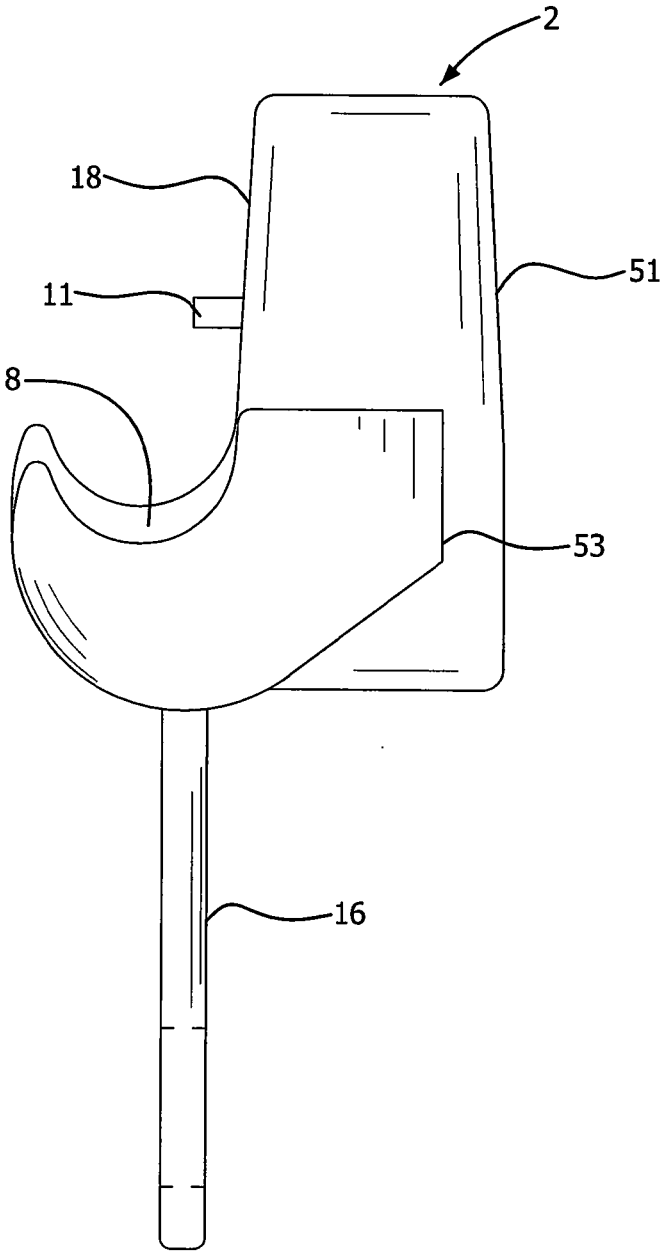
FIG. 9 is a side elevational view of the wedge pad of FIG. 8.
Figure 10:
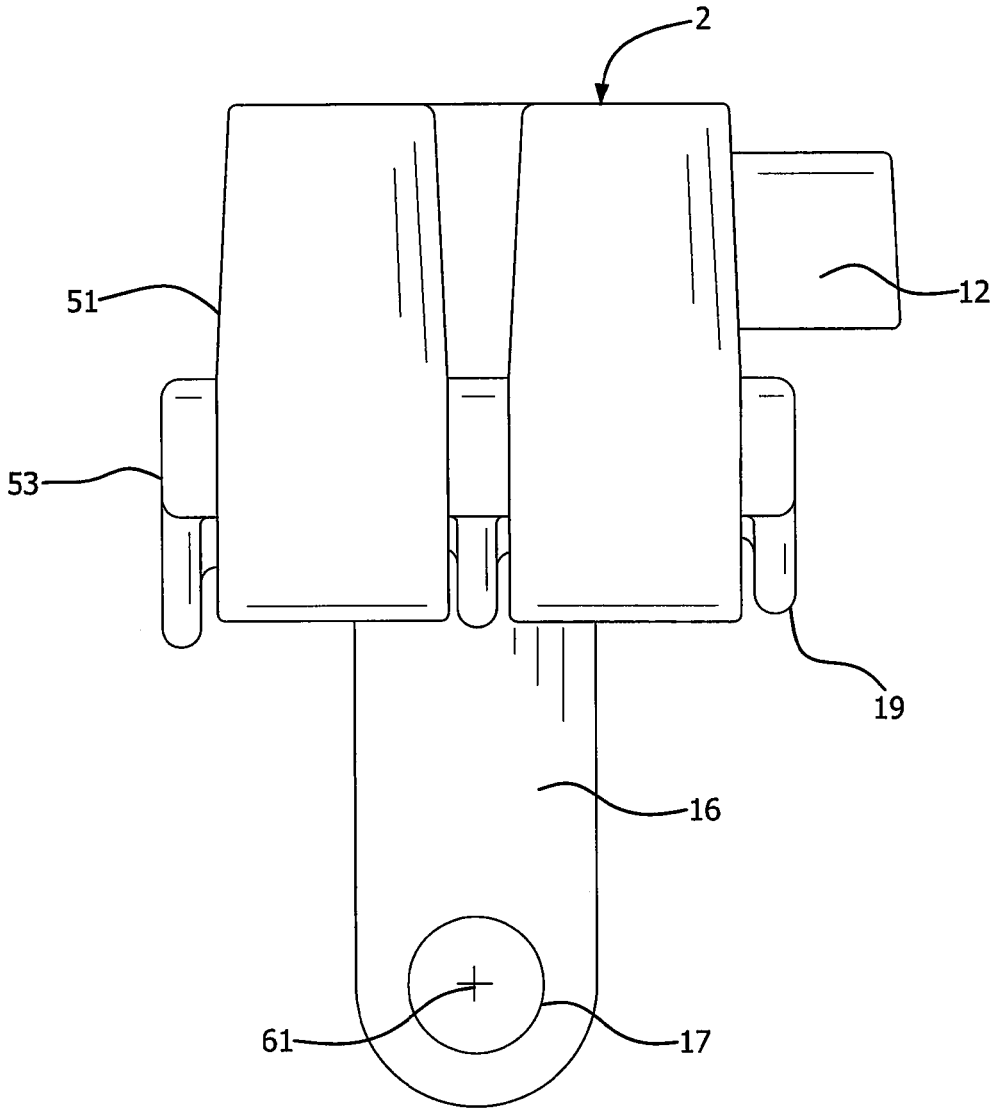
FIG. 10 is a rear elevational view of the wedge pad of FIG. 8.

A first tab 16 extends downwardly from the wedge pad 2, as shown in FIGS. 8-11, 14 and 15. Preferably, the first tab 16 extends downwardly from the receiving portion 53, as shown in FIGS. 8 and 14. A hole 17 in the first tab 16 allows the clamping device 7 to be engaged by a lineman's hot stick tool. A longitudinal axis 61 of the hole 17 is substantially perpendicular to the longitudinal axis 60 of the conductor 15, as shown in FIGS. 2 and 3.

Figure 31:
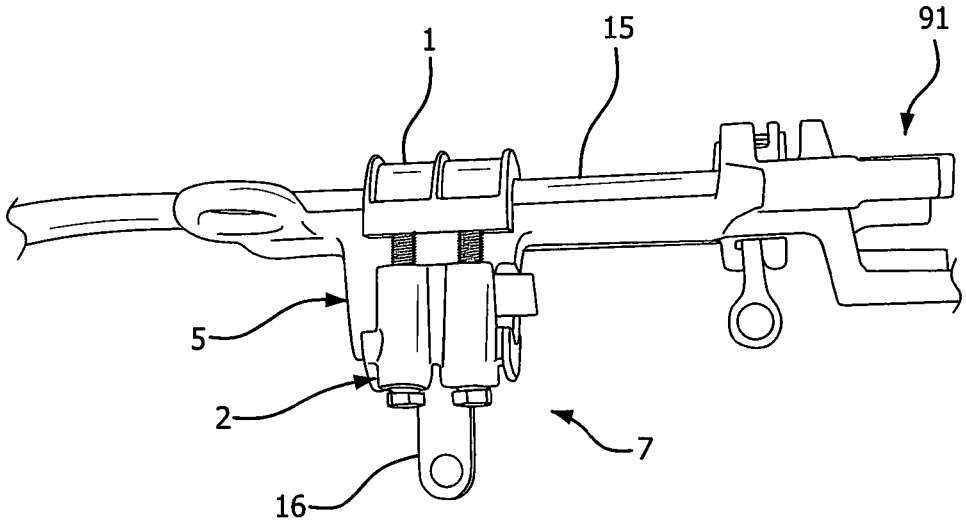
FIG. 31 is a rear elevational view of the clamping device of FIG. 1 connected to the wedge body of an in-line switch and receiving a conductor.
Figure 32:
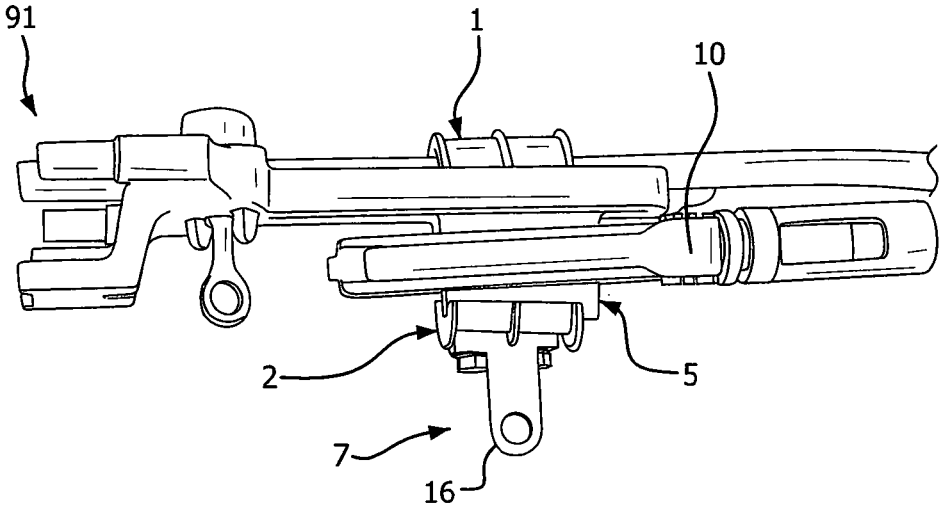
FIG. 32 is a front elevational view of a fire-on tool connected to the clamping device of FIG. 31.
Figure 33:
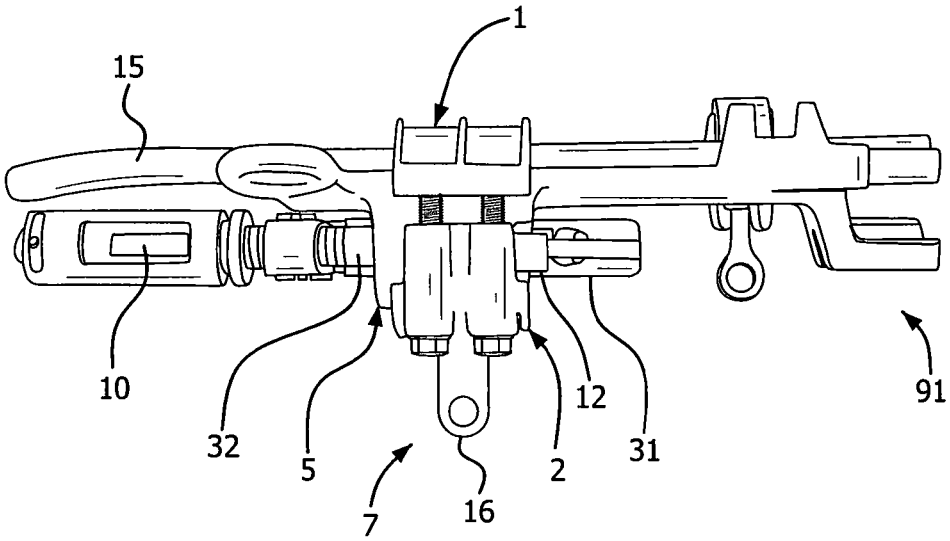
FIG. 33 is a rear elevational view of the fire-on tool connected to the clamping device of FIG. 32.

A second tab 12 extends outwardly from the wedge pad 2, as shown in FIGS. 12 and 13. Preferably, the second tab 12 extends from the main body 51 of the wedge pad 2 in a direction substantially parallel to the longitudinal axis 60 of the conductor 15, as shown in FIGS. 2 and 3. A fired-on tool 10, as shown in FIGS. 31-33, can be connected to the second tab 12 to facilitate connecting the conductor 15 to the in-line switch 91.

A stopping pin 11 extends outwardly from the wedge pad 2, as shown in FIGS. 13 and 14. Preferably, the stopping pin 11 extends from the second tab 12 and in a direction substantially perpendicular to the longitudinal axis 60 of the conductor 15.

Preferably, the wedge pad 2 is integrally formed as a once piece member.

Figure 6:
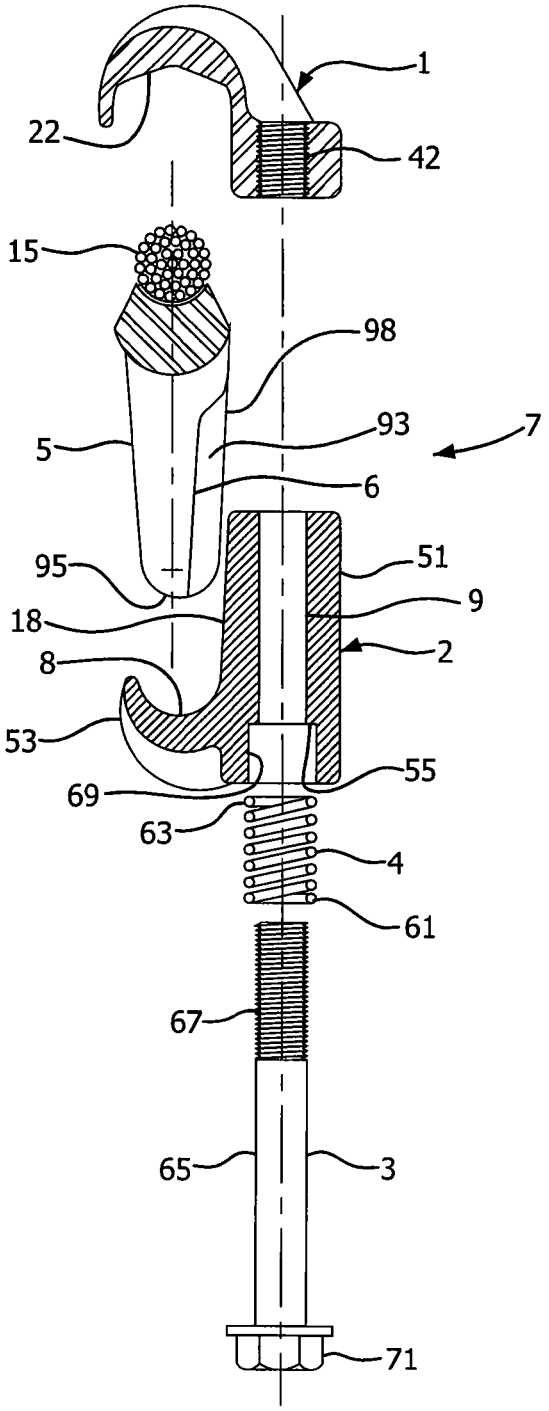
FIG. 6 is an exploded side elevational view in cross section of the clamping device of FIG. 1 receiving a conductor and a wedge body.
Figure 7:
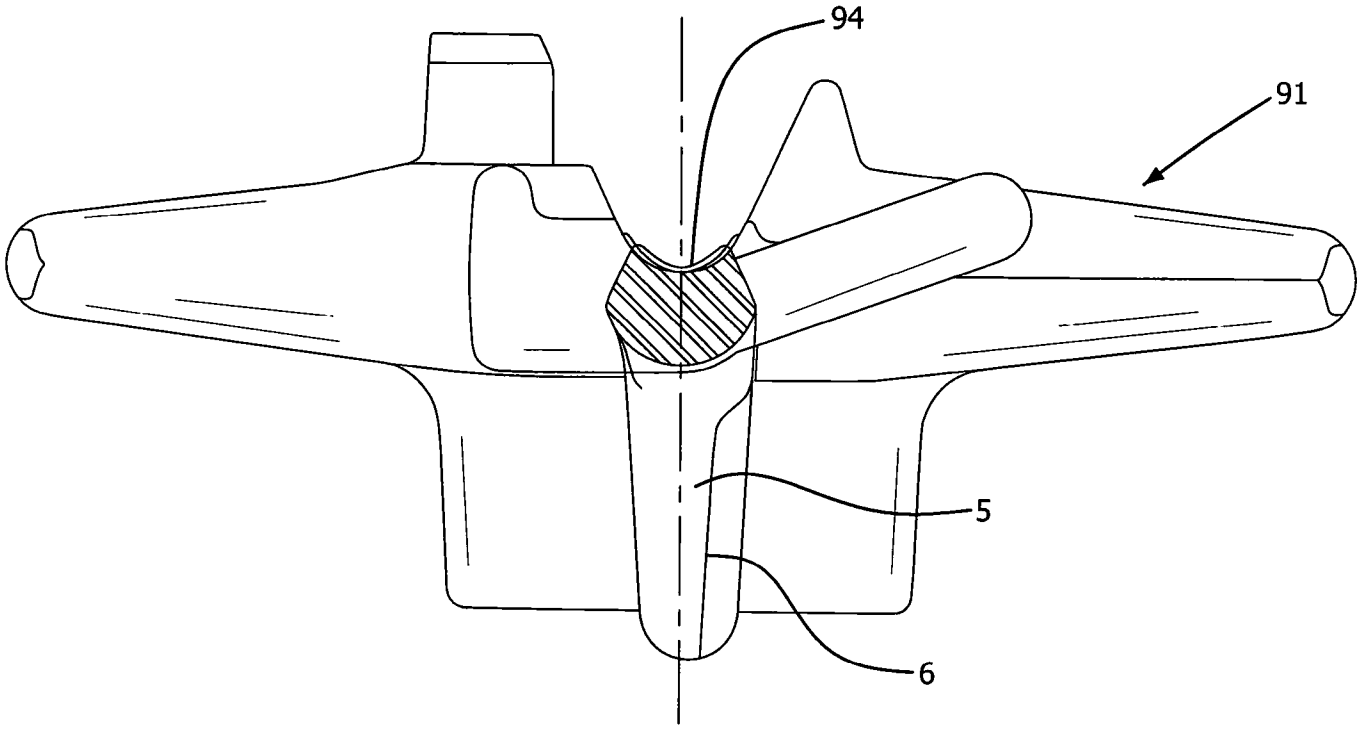
FIG. 7 is a side elevational view in cross section of a wedge body of the in-line switch of FIG. 1.

A spring member 4 is disposed on each of the first and second fasteners 3 and 53, as shown in FIG. 1. Preferably, the first and second fasteners 3 and 53 are bolts having an unthreaded portion 65 and a threaded portion 67, as shown in FIGS. 1 and 6. A first end 61 of the spring member 4 engages a head 71 of the fastener member 3, and a second end 63 engages the shoulder 55 of the counterbore 69. Preferably, the spring members 4 are compression springs having a compression rating of between approximately 10 to 15 pounds, inclusive.

The wedge pad 2 and the conductor pad 9 are preferably made of aluminum. The first and second fasteners and the first and second spring members are preferably made of stainless steel.

Figure 4:
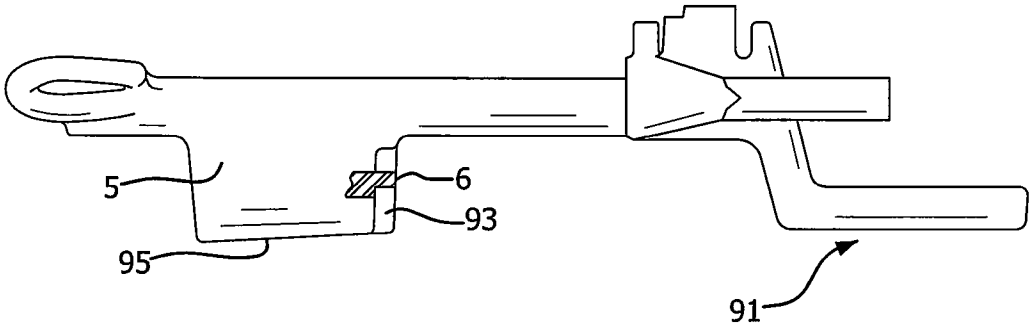
FIG. 4 is a front elevational view of a wedge body of the in-line switch of FIG. 1.
Figure 5:
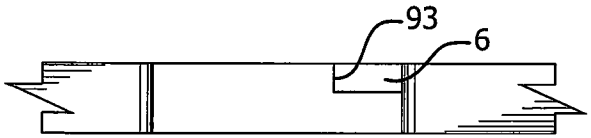
FIG. 5 is a partial bottom plan view of the wedge body of FIG. 4.
Figure 30:
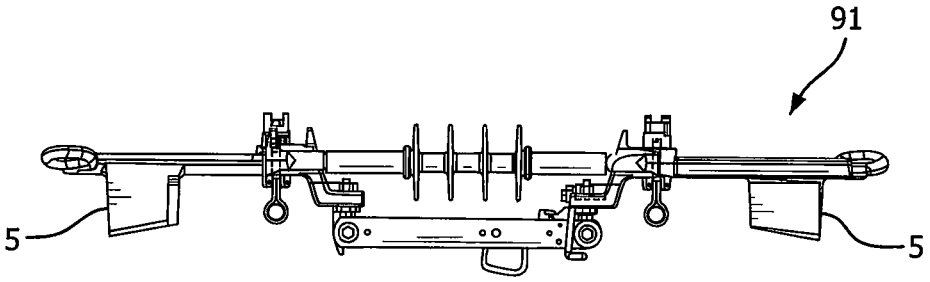

The wedge body 5 is rigidly fixed to the in-line switch 91, as shown in FIGS. 28 and 30. Preferably, as shown in FIG. 30, a wedge body 5 is disposed at opposite ends of the in-line switch 91. The wedge body 5 has a tapered surface 98 corresponding to the tapered surface 18 of the wedge pad 2, as shown in FIG. 1. A lower end 95 of the wedge body 5 is preferably tapered, as shown in FIG. 4. A cut-out portion 6 is formed in the wedge body 5, as shown in FIGS. 1, 4 and 5, and has an end wall 93. The end wall 93 is adapted to engage the stopping pin 11 to properly orient the clamping device 7 on the wedge body 5.

Assembly and Operation

As shown in FIGS. 1-3 and 31-33, the clamping device 7 is connected to the wedge body 5 of the in-line switch 91. However, the clamping device 7 can be connected to any suitable object to which a conductor is to be secured, such as a utility pole.

The first and second fastener members 3 and 33 are inserted through the holes 9 and 59 in the wedge pad 2 and though the corresponding holes 20 and 42 in the conductor pad 1, as shown in FIG. 1. The spring members 4 are disposed on the fastener members 3 and 33 prior to their insertion in the wedge pad 2 and the conductor pad 1 such that the spring members 4 are disposed in the counterbores 69 and 70 in the wedge pad 2.

The clamping device 7 is then slid over the wedge body 5 of the in-line switch 91. The stopping pin 11 is received by a cut-out portion 6 of the wedge body 5, as shown in FIG. 1, thereby preventing the clamping device 7 from being improperly installed on the wedge body 5. The clamping device 7 is slid along the wedge body 5 until the pin 11 abuts the end wall 93 of the cut-out portion 6 of the wedge body 5, thereby properly locating the clamping device 7 on the wedge body 5 and substantially preventing the clamping device 7 from being installed too far along the wedge body 5. When the clamping device 7 is moved forward during installation as indicated by the directional arrow 28 in FIG. 2, such as when installed using a fire-on tool, the pin 11 shears off to allow for further forward movement of the clamping device 7.

The conductor 15 is then passed through the clamping device 7 between the wedge body 5 and the conductor pad 1. The conductor 15 is received by the conductor groove 22 of the conductor pad 1 and a conductor groove 94 formed in the wedge body 5, as shown in FIG. 6. The wedge body receiving portion 8 receives the lower end 95 of the wedge body 5. As the first and second fasteners 3 and 33 are tightened, the first and second spring members 4 apply pressure in an upward direction as indicated by directional arrow 29 in FIG. 2 against the bottom of the wedge pad 2, as shown in FIG. 1, thereby creating a secure grip between the wedge and conductor pads 2 and 1 and the wedge body 5. The pressure is applied as shown in FIG. 2, such that force is applied on the conductor 15 by the conductor pad 1 as indicated by directional arrow 30 and the wedge body 5 as indicated by directional arrow 29.

The clamping device 7 can be installed by simply tightening the fastener members 3 and 33. Alternatively, a fired-on tool 10 can be connected to the tab 12 of the clamping device 7, as shown in FIGS. 32 and 33. The front 31 of the fired-on tool 31 contacts the tab 12 and the back 32 of the fired-on tool contacts the opposing edge of the wedge body 5. The clamping device 7 is propelled forward, as indicated by directional arrow 28 in FIG. 2, when the fired-on tool 10 is activated, thereby applying additional pressure to the conductor 15.

The tapered wedge body receiving surface 8 engages a corresponding tapered surface 95 of the wedge body 5. As the clamping device 7 moves forward, as indicated by directional arrow 28 in FIG. 2, the engagement between the tapered surfaces 8 and 95 causes the clamping device 7 to apply more force on the conductor 15, thereby more securely connecting the conductor 15 to the in-line switch 91.

The inner tapered surface 18 of the wedge pad 2 makes full contact with the wedge body tapered surface 98, as shown in FIGS. 1 and 6, thereby substantially preventing the wedge pad 2 from distorting when force is applied thereto. Preferably, the inner tapered surface 18 of the wedge pad 2 forms an angle of approximately 10 degrees with the vertical, as shown in FIG. 6.

As the clamping device 7 moves forward, the corresponding tapered surfaces 8 and 95 apply additional pressure on the conductor 15. Such forward movement of the clamping device 7 also causes the pin 11 to shear off as the pin 11 moves past the end wall 93 of the cut-out portion 6 of the wedge body 5.

The clamping device 7 is easily removed by loosening the fastener members 3 and 33. The wedge pad 2 can then be spaced from the conductor pad 1 such that the grip on the conductor 15 is loosened and the clamping device 7 can be slid off the wedge body 5. The clamping device 7 can then be reused.

As shown in FIGS. 22-27, various diameter conductors 15 and various size wedge bodies 5 can be accommodated by the clamping device 7. The various sizes are accommodated by adjusting the amount that the threaded portions 67 (FIG. 4) of the fastener members 3 are threadably engaged with the holes 20 in the conductor pad 1.

The foregoing embodiment and advantages are merely exemplary and are not to be construed as limiting the scope of the present invention. The description of an exemplary embodiment of the present invention is intended to be illustrative, and not to limit the scope of the present invention. Various modifications, alternatives and variations will be apparent to those of ordinary skill in the art, and are intended to fall within the scope of the invention as defined in the appended claims.

What is claimed is:

1. An adjustable clamping device, comprising:

a wedge pad having a first fastener hole and a wedge receiving surface;

a conductor pad having a second fastener hole and a conductor receiving surface receiving a conductor along a length thereof and extending along a horizontal axis, said conductor receiving surface facing said wedge receiving surface receiving a wedge to clamp a conductor between said wedge and said conductor pad;

a wedge receiving surface on said wedge pad sloping along a length thereof between first and second longitudinal ends thereof at an acute angle relative to said horizontal axis, said wedge being moved toward said conductor pad by moving along said wedge receiving surface in a direction from said first end to said second end;

a fastener received by said first and second fastener holes to adjustably connect said wedge pad to said conductor pad; and a spring member disposed on said at least one fastener, abutting said wedge pad and biasing said wedge pad toward said conductor pad to facilitate retaining the wedge and the conductor between said wedge receiving surface and said conductor receiving surface.

2. The adjustable clamping device according to claim 1, wherein said second fastener hole is threaded.

3. The adjustable clamping device according to claim 2, wherein said fastener member has a non-threaded portion to engage said first fastener hole and a threaded portion to engage said second fastener hole.

4. The adjustable clamping device according to claim 3, wherein an amount of said threaded portion received by said first fastener hole is varied to accommodate different conductor and wedge sizes.

5. The adjustable clamping device according to claim 1, wherein said first fastener hole has a counterbore to receive said spring member.

6. The adjustable clamping device according to claim 1, wherein said spring member is a compression spring.

7. The adjustable clamping device according to claim 1, wherein a plurality of ribs are formed on said conductor receiving surface to facilitate receiving the conductor.

8. The adjustable clamping device according to claim 1, wherein said acute angle is approximately 10 degrees.

9. The adjustable clamping device according to claim 1, wherein a tab extends downwardly from said wedge pad and has an opening therein to receive a tool.

10. The adjustable clamping device according to claim 1, wherein a plurality of ribs are formed on an outer surface of said wedge pad.

11. The adjustable clamping device according to claim 1, wherein a plurality of ribs are formed on an outer surface of said conductor pad.

12. The adjustable clamping device according to claim 1, wherein said conductor receiving surface has a first surface and a second surface, said first and second surfaces forming different angles with a horizontal axis.

13. A clamping device, comprising:

a wedge pad having a first fastener hole and a wedge receiving surface;

a conductor pad having a second fastener hole and a conductor receiving surface, said conductor receiving surface facing said wedge receiving surface to receive a wedge and a conductor therebetween;

a fastener received by said first and second fastener holes to adjustably connect said wedge pad to said conductor pad; and a stopping pin fixedly extending from said wedge pad to position said wedge pad with respect to the wedge.

14. The clamping device according to claim 13, wherein said stopping pin extends substantially perpendicular to a longitudinal axis of said first fastener hole.

15. The clamping device according to claim 13, wherein said stopping pin is shearable by movement of the wedge during installation.

16. A method of securing a conductor, comprising the steps of securing a wedge pad to a conductor pad with a fastener having a spring disposed thereon;

sliding the wedge pad and the conductor pad along a wedge, a wedge receiving surface of the wedge pad being sloped along a length thereof between first and second longitudinal ends at an acute angle relative to a horizontal axis to facilitate receiving the wedge;

passing a conductor between the wedge and the conductor pad; and tightening the fastener to secure the wedge and conductor between the wedge pad and the conductor pad.

17. The method of securing a conductor according to claim 16, wherein the wedge pad is slid on the wedge until the wedge abuts a stop pin extending outwardly from the wedge pad.

18. The method of securing a conductor according to claim 16, wherein the amount of the fastener received by the conductor pad is adjusted to accommodate different sizes of the conductors and the wedges.

19. The method of securing a conductor according to claim 17, further comprising shearing off the stop pin with the wedge during installation.

* * * * *